US006373449B1

(12) United States Patent
Bokulic et al.

(10) Patent No.: US 6,373,449 B1
(45) Date of Patent: Apr. 16, 2002

(54) HYBRID INFLATABLE ANTENNA

(75) Inventors: Robert S. Bokulic, Columbia; Cliff E. Willey, Millersville; William E. Skullney, Granite; Ronald C. Schulze, Catonsville, all of MD (US)

(73) Assignee: The Johns Hopkins University, Baltimore, MD (US)

( * ) Notice: Subject to any disclaimer, the term of this patent is extended or adjusted under 35 U.S.C. 154(b) by 0 days.

(21) Appl. No.: 09/666,417

(22) Filed: Sep. 20, 2000

Related U.S. Application Data

(60) Provisional application No. 60/154,888, filed on Sep. 21, 1999.

(51) Int. Cl.[7] ..... H01Q 15/20

(52) U.S. Cl. ..... 343/915; 343/840; 343/912

(58) Field of Search ..... 343/915, 912, 343/840, 914, DIG. 2; H01Q 15/12, 15/14, 15/20, 15/00

(56) References Cited

U.S. PATENT DOCUMENTS

| | | | | | |
|---|---|---|---|---|---|
| 3,541,569 | A | | 11/1970 | Berks et al. | 345/915 |
| 3,576,566 | A | * | 4/1971 | Cover | 343/705 |
| 3,599,218 | A | * | 8/1971 | Williamson | 343/840 |
| 3,717,879 | A | | 2/1973 | Ganssle | 343/915 |
| 4,352,112 | A | | 9/1982 | Leonhardt et al. | 343/915 |
| 4,364,053 | A | | 12/1982 | Hotine | 343/915 |
| 4,394,780 | A | | 7/1983 | Mooradian | 455/618 |
| 4,672,389 | A | | 6/1987 | Ulry | 343/915 |
| 4,741,609 | A | | 5/1988 | Sallis | 350/608 |
| 4,755,819 | A | | 7/1988 | Bernasconi et al. | 343/915 |
| 5,132,699 | A | | 7/1992 | Rupp et al. | 343/880 |
| 5,166,696 | A | | 11/1992 | Rupp et al. | 343/711 |
| 5,202,689 | A | | 4/1993 | Bussard et al. | 342/10 |
| 5,515,067 | A | | 5/1996 | Rits | 343/912 |
| 5,680,145 | A | | 10/1997 | Thomson et al. | 343/915 |
| 5,755,400 | A | * | 5/1998 | Kalms | 244/3.17 |
| 5,920,294 | A | * | 7/1999 | Allen | 343/912 |
| 6,104,358 | A | * | 8/2000 | Parker et al. | 343/915 |
| 6,137,454 | A | * | 10/2000 | Peck | 343/912 |
| 6,219,009 | B1 | * | 4/2001 | Shipley et al. | 343/915 |

FOREIGN PATENT DOCUMENTS

| | | |
|---|---|---|
| GB | 2 188 166 A | 9/1987 |

* cited by examiner

*Primary Examiner*—Tho G. Phan
(74) *Attorney, Agent, or Firm*—Ernest R. Graf; Carla Magda Krivak

(57) ABSTRACT

An inflatable antenna system combining a fixed aperture with an inflatable aperture that greatly increases the reflector size of the antenna system. The fixed portion provides a "risk buffer" in that a moderate gain capability is retained in the event of an inflation failure. In a parabolic dish embodiment, an inflatable annulus is stowed compactly under a fixed dish to fit a variety of spacecraft and launch vehicle envelopes. Moderate gas pressure deploys the inflatable portion, which forms a larger reflector surface. After inflation, the materials that form the inflated reflector surface can be made rigid. A fixed feed system for the smaller fixed dish assures operation of the smaller fixed dish throughout the mission. Moreover, the smaller fixed antenna can receive signals that can be used to derive pointing information used to point the larger inflated antenna in a particular direction thus providing a dual-use capability. An optional sub-reflector feed system can be used to correct for surface shape deformations of the inflatable antenna.

20 Claims, 4 Drawing Sheets

HYBRID INFLATABLE ANTENNA

RELATED APPLICATIONS

This application is related to Provisional Application No. 60/154,888 filed Sep. 21, 1999.

FIELD OF THE INVENTION

The present invention relates generally to a hybrid inflatable antenna system that combines a fixed antenna with an inflatable portion.

BACKGROUND OF THE INVENTION

Inflatable antennas are the focus of current space technology research because of their potential for enabling high bit rate data communication. Current inflatable antenna designs use gas inflation to deploy and form the reflector surface. The capability of the antenna depends on the success of the inflation process and the accuracy in rigidizing the reflector surface. This process can be a significant risk to the mission if there is not a backup system. Large inflatable antenna systems are often designed for "all-or-nothing" and if they don't work, the satellite mission can be a complete loss. For this reason, the application of inflatable antennas is presently limited mainly to missions where a very large aperture is needed to enable the mission. Examples of such missions include interstellar probes and large imaging radar satellites.

What is needed is an inflatable antenna system that can return a high bit rate from space while maintaining a mission-critical moderate bit rate backup capability in case of inflation failure.

SUMMARY OF THE INVENTION

A hybrid inflatable antenna system has been developed that avoids the aforementioned "all-or-nothing"scenario by providing backup capability in the event of an inflation failure. The system combines a fixed radiating area with an inflatable portion to greatly increase the radiating area of the antenna system while in orbit. The fixed portion provides a "risk buffer"in that moderate gain capability is retained in the event of an inflation failure. A fixed feed system assures operation of the smaller fixed portion of the antenna throughout the mission regardless of whether inflation of the larger portion of the antenna is successful.

In accordance with a first embodiment of the invention is a hybrid inflatable parabolic dish antenna system. The system is comprised of a fixed dish antenna portion capable of moderate bit rate data transmissions and a stowable inflatable annulus portion. The system also includes means for deploying the inflatable annulus portion thereby providing the overall hybrid dish antenna system with a larger reflective surface capable of higher bit rate data transmissions. First and second feed systems operatively illuminate the smaller fixed dish antenna portion and the larger inflated dish antenna portion, respectively.

The first feed system is fixed (non-deployed) thereby providing guaranteed operation of the smaller fixed dish portion of the antenna system. The second feed system may be either fixed or deployed for operation of the larger inflated dish portion of the antenna system. The fixed and inflated portions of the antenna system may be operated simultaneously, if desired, to provide separate apertures for uplink and downlink communications. In this configuration, a dual function capability exists whereby an uplink signal received by the smaller aperture can be used to provide pointing information for a downlink signal transmitted by the larger aperture.

The inflatable annulus is stowed compactly under the fixed dish portion to fit a variety of spacecraft and launch vehicle envelopes. Moderate gas pressure deploys the annulus which then forms a parabolic reflector surface. After inflation, the materials that comprise the annulus surface may be rigidized using temperature, ultra violet (UV), or other curing methods. For example, the present invention can be applied to a typical one (1) meter fixed dish to increase its diameter to four (4) meters or more. An inflated four (4) meter dish antenna can return a bit rate on the order of 1 Mbps from Mars using a 30 watt $K_a$-band power amplifier.

In accordance with a second embodiment, a hybrid inflatable antenna includes first and second feed systems. The first feed system operatively illuminates the fixed antenna portion. The second feed system includes a feed antenna and a sub-reflector. The sub-reflector reflects signals from the feed antenna onto the inflatable antenna portion. The sub-reflector is axially symmetric and its nominal shape can be elliptical or hyperbolic. In addition, its shape can be modified and optimized to correct for deformations on the inflatable antenna portion. The sub-reflector can include an array of RF reflective elements that can be remotely adjustable. Other aspects and features of the present invention will become apparent to those ordinarily skilled in the art upon review of the following description of specific embodiments of the invention in conjunction with the accompanying figures.

DETAILED DESCRIPTION OF THE INVENTION

A first embodiment of the present invention forms a hybrid inflatable dish antenna that combines a fixed parabolic antenna with an inflatable annulus to greatly increase dish reflector area. The concept of the present invention is applicable, however, to any number of antenna shapes and sizes without departing from the spirit or scope of the present invention. A typical embodiment specifies a smaller diameter fixed dish antenna system with a deployable annulus that inflates to form a larger diameter dish antenna system.

Figure 1:
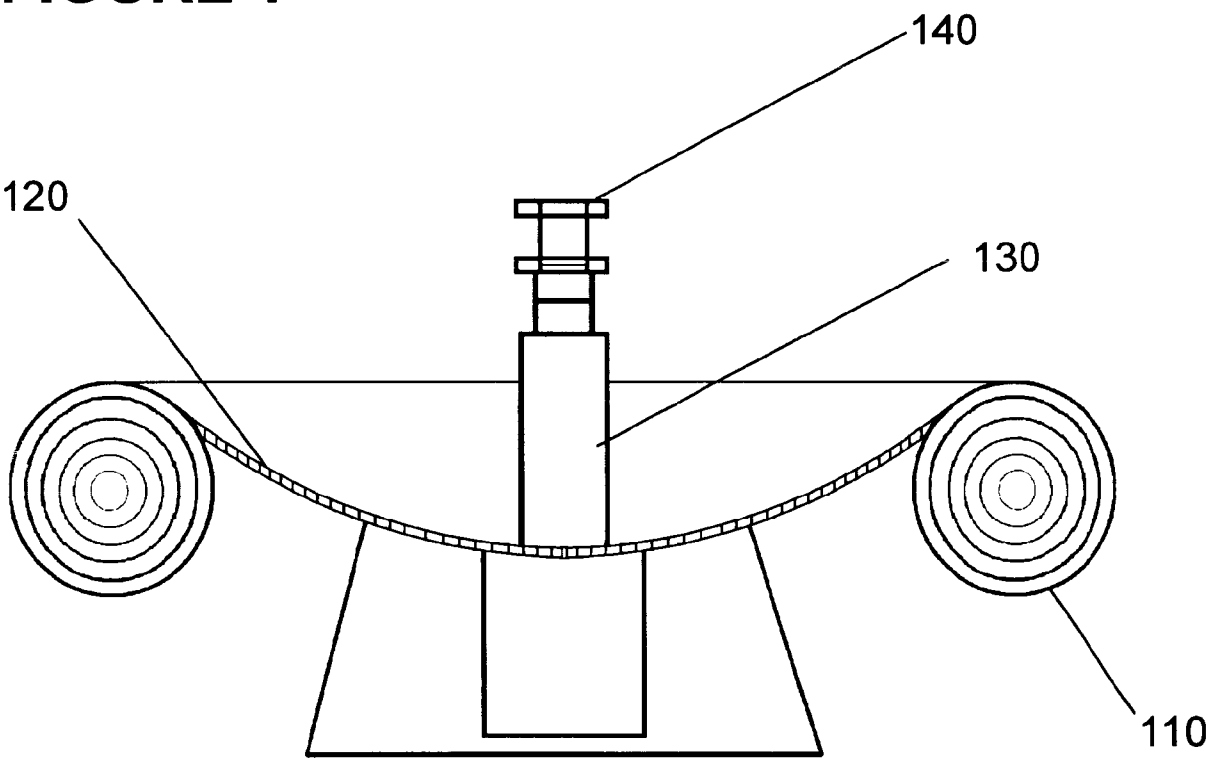
FIG. 1 illustrates a cross-sectional view of a dish antenna system in its stowed position according to a first embodiment of the present invention.

It is expected that the mass and volume of the hybrid inflatable antenna system will be significantly less than that of mechanically deployed dish antenna systems. Referring now to FIG. 1, a cross-sectional view of the hybrid inflatable dish antenna system is shown in its stowed position. An inflatable dish annulus 110 is stowed compactly beneath the fixed portion 120 of the dish antenna system. This allows the dish antenna system to fit a variety of spacecraft and launch vehicle envelopes. Fixed portion 120 can be comprised of standard dish antenna materials. Most of the inflatable dish annulus 110 is stowed under the rigid fixed portion 120 of the inflatable dish antenna system through a combination of folding and rolling of the material. Feed support 130 includes two (2) feed systems. One feed system 140 is for operation with the fixed portion 120 of the dish antenna system. Portions of the feed system support 130 can be deployed outward to place another feed system (150 not shown in FIG. 1, but shown in FIG. 2) at the proper position to illuminate the inflated dish aperture. Thus, the other feed system (150) is for operation of the dish antenna system upon inflation. Although illustrated as a simple mast in FIG. 1, the feed support 130 can be implemented in a variety of ways including a series of struts or an offset mount.

Figure 2:
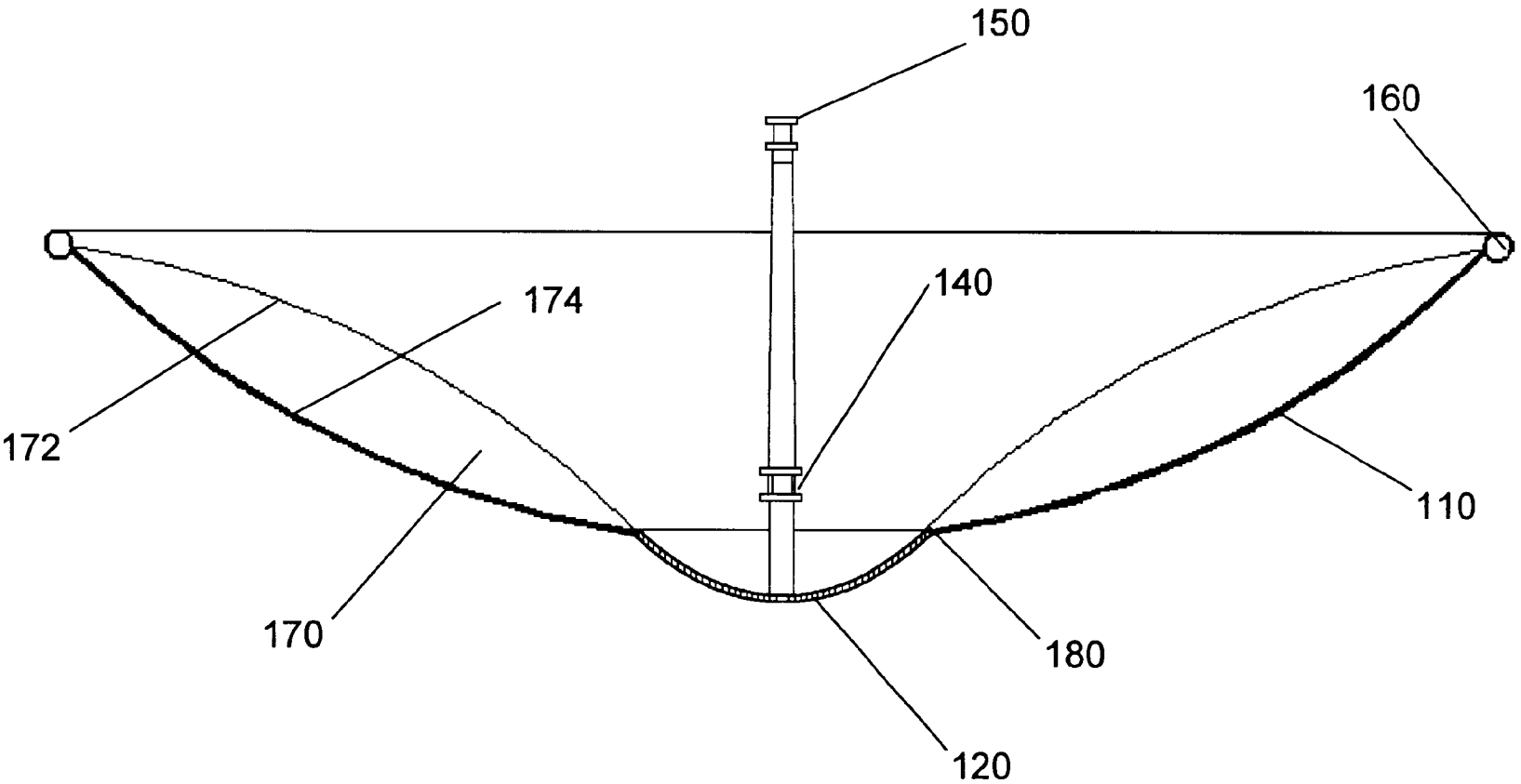
FIG. 2 illustrates a cross-sectional view of the dish antenna system in its inflated position according to the first embodiment of the present invention.
Figure 3:
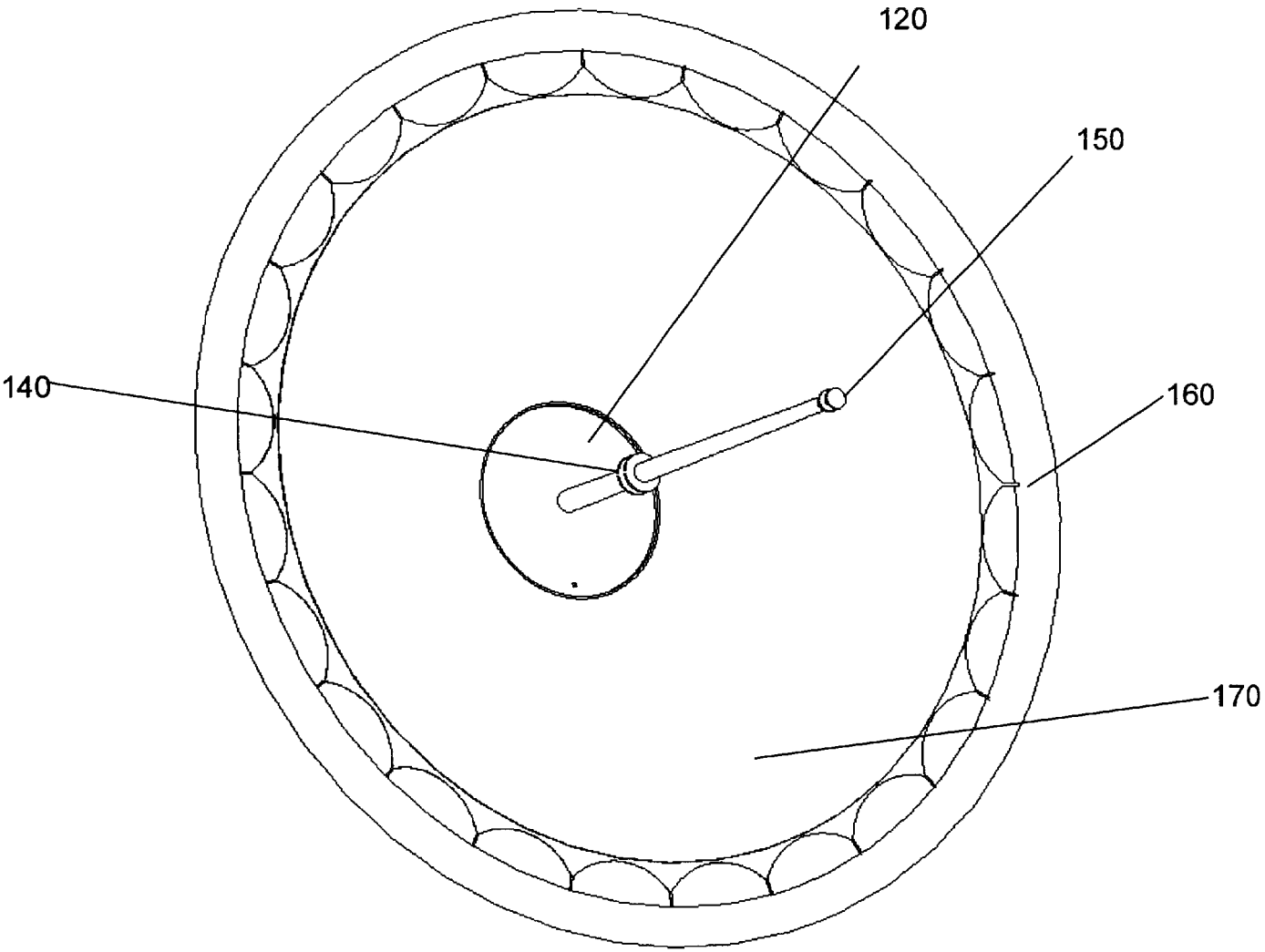
FIG. 3 illustrates an isometric view of the dish antenna system shown in FIG. 2 according to the first embodiment of the present invention.

FIG. 2 is a cross-sectional view and FIG. 3 is an isometric view of the inflatable dish antenna system shown in its inflated configuration. In these figures, inflatable annulus 110 has been deployed to achieve a dish antenna system of greater diameter. Both feed systems 140, 150 are now shown.

Feed system 140 is fixed (i.e., non-deployed) and illuminates the smaller fixed portion 120 of the dish antenna system providing moderate gain capability as a backup to the larger inflated dish antenna. Feed system 150 illuminates the inflated dish antenna area providing high gain capability. In a typical application, the smaller fixed antenna might be capable of both uplink and downlink operation, while the larger deployed antenna is capable of high bit rate downlink operation. Due to its broader beamwidth, the smaller fixed antenna can serve as an acquisition and tracking aid for pointing of the larger deployed antenna thereby providing dual-use capability.

During the inflation process in this described embodiment, a rim torus tube 160 inflates, driving the deployment of annulus 110. A gas pressure system is used to inflate rim torus tube 160. As the gas pressure increases, the inflatable annulus 110 deploys and expands until it is fully inflated. Rim torus tube 160 forms a rim about the outer periphery of the inflated annulus and provides stiffness and maintains the accuracy of the inflated dish antenna shape. Deployment of annulus 110 creates an inflation chamber 170. The outer materials 172 of this chamber are radio frequency (RF) transparent meaning they will not affect dish antenna performance. The inner parabolic surface 174 is RF reflective.

Because the fixed portion 120 and the inflated portion 110 of the dish antenna system combine to form a reflective surface, there exists a transition point 180 between the two antenna portions. The shape of the parabolas are potentially different depending on design constraints on the feed systems 140, 150.

The simple feed configuration shown by the feed system 150 in FIG. 2 requires a highly accurate parabolic surface (in that example) to maintain reasonable antenna efficiency. The required accuracy for a reflector surface shape, operating in the $K_a$-band, is on the order of ±0.3 mm to ±0.5 mm. This might be difficult to maintain for an inflated annulus. If the surface accuracy deviates significantly from the parabolic shape, then a shaped sub-reflector feed can be used to correct distortions on the reflector surface. This increases the efficiency of the inflated annulus. There are several sub-reflector feed configurations that can be used for this purpose. One example of the many available types of configurations is given below.

Figure 4:
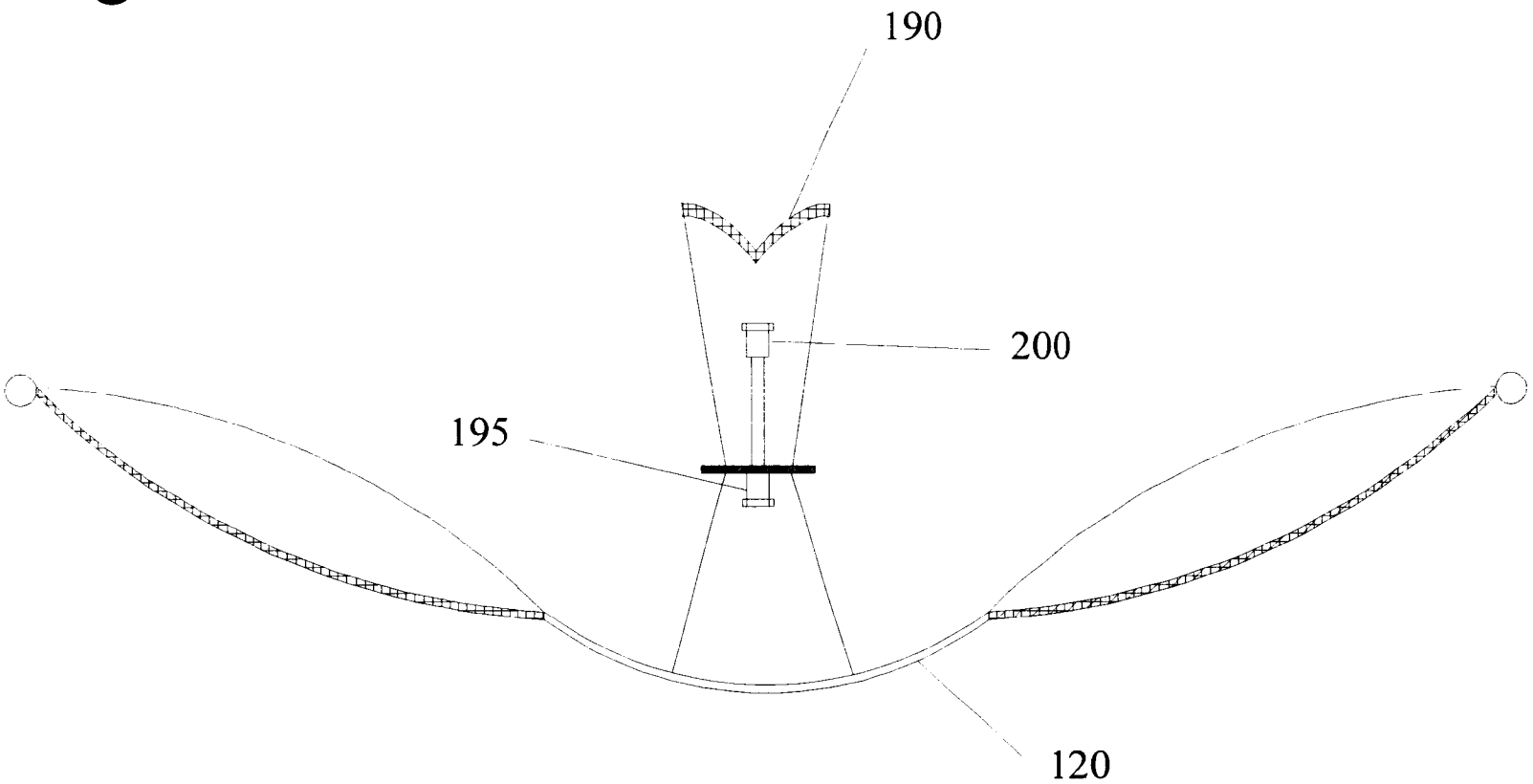
FIG. 4 illustrates a cross-sectional view of a dish antenna system in its inflated position according to a second embodiment of the present invention.

FIG. 4 shows a second embodiment of the present invention. This embodiment replaces the feed system 150 (a prime focus feed system) shown in FIG. 2 with an axially symmetric Gregorian feed system. This type of feed system includes a sub-reflector splash plate 190 and a feed antenna 200.

The feed system shown in FIG. 4 has a first feed system 195 that is similar to the feed system 140 in the previous embodiment. A second feed system is provided that includes a feed antenna 200, in this example, a feed horn, and the sub-reflector splash plate 190. The signals from the feed horn 200 reflect off the splash plate 190 onto the inflatable portion 110. Thus, this embodiment provides the advantage that the splash plate 190 can be used to direct energy onto the inflated annulus 110 and not necessarily onto the fixed portion 120 of the hybrid inflatable antenna.

In this embodiment, the splash plate 190 has an axially symmetric surface and its nominal shape is elliptical. The nominal shape of the splash plate 190 can also be hyperbolic. The exact shape of the splash-plate reflector 190 depends on the distortion profile of the inflated annulus. The surface of the splash plate reflector 190 can be modified and optimized to correct for the slowly varying deformations on the inflated annulus 110. That is, the shape of the splash plate 190 can be perturbed to adjust for any deformities in the inflated portion 110 of the hybrid inflatable antenna. The splash plate reflector 190 can be implemented as a shaped metallic conducting surface or as an array of RF reflective elements (i.e., printed microstrip patches, rings, dipoles, etc.) that behave in a manner similar to a shaped metallic conducting surface. In the latter case, the shape of the reflective surface can be flat and need not necessarily be elliptical or hyperbolic. The array of RF reflective elements can be modified and/or optimized remotely.

In this embodiment, feed antenna 195 is shown to directly illuminate the fixed portion 120 of the hybrid inflatable antenna. The gain performance of the fixed portion is reduced due to blockage from the splash plate 190. The overall efficiency of the fixed portion 120 can be improved by using a feed system that directs RF energy away from the splash plate 190. An axially symmetric sub-reflector feed system can be used for feed antenna 195 to improve overall efficiency of the fixed portion 120.

After inflation of the annulus 110, the materials of the parabolic surface of the inflated annulus can be rigidized using temperature, UV, or other curing methods. If rigidization is used, then a controlled release of the gas pressure used to inflate the antenna occurs after the composites have cured. Gas pressure is not required to maintain the shape of the dish once cured. The foregoing process serves to form a stiffer parabolic reflector surface that will minimize distortion caused by spacecraft orbit dynamics. Rigidization also provides an important capability to withstand micrometeorite punctures, assuring long term reliability of the inflated dish antenna structure.

Development of the hybrid inflatable dish antenna system can have a major impact on future satellites that require high data rates from space. For instance, a NASA goal is to have 1 Mbps transmission capability from Mars in order to enable high-resolution television transmissions. Preliminary calculations indicate that a $K_a$-band (32 GHz) antenna that is inflatable to a four (4) meter diameter can return 1 Mbps from a typical Mars-to-Earth distance using a 30 watt amplifier. In contrast, a one (1) meter diameter $K_a$-band antenna can return only 62 Kbps. These calculations assume a 34 meter diameter ground antenna.

The commercial satellite industry may also benefit by using a large inflatable antenna that retains a modest customer service capability in the event of an inflation failure.

The fixed portion of the dish antenna provides a mission risk buffer in that moderate gain capability is retained even if only the smaller diameter fixed portion of the dish antenna is operable. This is important in case of an inflation failure. The fixed, rigid feed system assures operation of the smaller diameter dish antenna throughout the mission. Dual frequency capability of the smaller dish antenna can provide simultaneous uplink/downlink capability and provide a means for pointing the larger dish. In the latter case, the smaller dish antenna might be used to track an uplink beacon signal to provide pointing information for the larger inflated downlink antenna.

Additional reliability and cost savings are also obtained from the relatively simple deployment method. Very few mechanisms and moving parts are required to inflate the hybrid antenna system. Moreover, the gas pressure system responsible for inflating the hybrid antenna system comprises a small number of low cost components. Moreover, these components may already exist on the spacecraft. As a result, greater reliability and lower cost is achieved as compared to motor driven antenna deployment systems.

The present invention has several significant advantages over current spacecraft antenna systems. These advantages include a scaleable high gain antenna architecture, compact packaging, enhanced RF performance in orbit, and risk mitigation. Further, the fixed portion of the antenna and the inflatable portion of the antenna can be any shape or size and are not limited to the embodiment disclosed herein. In addition, the feed antenna systems can be supported in a variety of manners including, but not limited to, a mast, support struts, or an offset mount.

In the following claims, any means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

What is claimed is:

1. A hybrid inflatable antenna system comprising:

a fixed antenna portion having independent moderate gain capability;

a stowable inflatable antenna portion; and means for deploying said stowable inflatable antenna portion thereby providing the antenna system with a larger reflective surface capable of increased data rate communications.

2. The inflatable antenna system of claim 1 wherein, said fixed antenna portion is parabolic.

3. The inflatable antenna system of claim 2 wherein, said inflatable portion forms a parabolic annulus upon deployment.

4. The inflatable antenna system of claim 3 wherein, said means for deploying said inflatable parabolic annulus antenna portion comprises a release of pressurized gas into inflation chambers causing said inflatable parabolic annulus antenna portion to deploy thereby creating a larger parabolic antenna portion attached to said fixed parabolic antenna portion.

5. The inflatable antenna system of claim 4 wherein, upon deployment of said inflatable parabolic annulus antenna portion, a curing process is applied to the inflated parabolic annulus portion of the antenna system in order to rigidize said inflated parabolic annulus portion.

6. The inflatable antenna system of claim 1 wherein, upon deployment of said stowable inflatable antenna portion, a curing process is applied thereto to rigidize said stowable inflatable antenna portion.

7. The inflatable antenna system of claim 1 wherein, said inflatable portion forms a parabolic annulus upon deployment.

8. A hybrid inflatable antenna system comprising:

a fixed antenna portion;

a stowable inflatable antenna portion;

means for deploying said stowable inflatable antenna portion thereby providing the antenna system with a larger reflective surface capable of increased data rate communications; and first and second feed systems;

wherein, upon deployment of the inflatable portion, said first feed system operatively illuminates said fixed antenna portion and said second feed system operatively illuminates said inflatable antenna portion such that the fixed portion and the inflatable portion are operative providing simultaneous dual antenna capability, and said fixed antenna portion is smaller than said inflatable antenna portion.

9. The inflatable antenna system of claim 8, wherein said smaller fixed antenna portion receives a signal from which directional information is derivable to point said inflatable antenna portion in a particular direction.

10. The inflatable antenna system of claim 8, wherein in the event of an-inflation failure the combination of said first feed system with said fixed portion of the antenna system remains operative to transmit and receive signals.

11. The inflatable antenna system of claim 8, wherein said means for deploying said inflatable antenna portion comprises a release of pressurized gas into inflation chambers causing said inflatable antenna portion to deploy.

12. A hybrid inflatable antenna system comprising:

a parabolic fixed antenna portion;

a stowable inflatable antenna portion that forms a parabolic annulus upon deployment; and means for deploying said stowable inflatable antenna portion, said means comprising a release of pressurized gas into inflation chambers thereby creating a larger parabolic antenna portion attached to said parabolic fixed antenna portion and providing the antenna system with a larger reflective surface capable of increased data rate communications;

wherein, upon deployment of said stowable inflatable antenna portion, the stowable inflatable antenna portion forms an inflation chamber having an inner parabolic surface comprised of radio frequency (RF) reflective materials and an outer surface comprised of radio frequency (RF) transparent materials.

13. A hybrid inflatable antenna system comprising:

a parabolic fixed antenna portion;

a stowable inflatable antenna portion that forms a parabolic annulus upon deployment; and means for deploying said stowable inflatable antenna portion, said means comprising a release of pressurized gas into inflation chambers thereby creating a larger parabolic antenna portion attached to said parabolic fixed antenna portion and providing the antenna system with a larger reflective surface capable of increased data rate communications;

wherein, upon deployment of said stowable inflatable antenna portion, 1) a curing process is applied to the inflated parabolic annulus portion of the antenna system in order to rigidize said inflated parabolic annulus portion, and 2) the stowable inflatable antenna portion forms an inflation chamber having an inner parabolic surface comprised of radio frequency (RF) reflective materials and an outer surface comprised of radio frequency (RF) transparent materials.

14. A hybrid inflatable antenna system comprising:

a fixed antenna portion;

stowable inflatable antenna portion that is stowed under said fixed antenna portion before deployment; and means for deploying said stowable inflatable antenna portion thereby providing the antenna system with a larger reflective surface capable of increased data rate communications.

15. A hybrid inflatable antenna system comprising:

a fixed antenna portion;

a stowable inflatable antenna portion;

means for deploying said stowable inflatable antenna portion thereby providing the antenna system with a larger reflective surface capable of increased data rate communications; and first and second feed systems, said first feed system operatively illuminating said fixed antenna portion and said second feed system comprises:

a feed antenna that radiates signals; and a sub-reflector reflecting the signals from said feed antenna onto said inflatable antenna portion, said sub-reflector is modified and optimized to correct for shape deformations on said inflatable antenna portion.

16. A hybrid inflatable antenna system comprising;

a parabolic fixed antenna portion;

a stowable inflatable antenna portion that forms a parabolic annulus upon deployment;

means for deploying said stowable inflatable antenna portion thereby providing the antenna system with a larger reflective surface capable of increased data rate communications; and first and second feed systems, said first feed system operatively illuminating said fixed antenna portion and said second feed system comprises:

a feed antenna that radiates signals; and a sub-reflector reflecting the signals from said feed antenna onto said inflatable antenna portion, said sub-reflector is modified and optimized to correct for shape deformations on said inflatable antenna portion.

17. The inflatable antenna system of claim 16, wherein said sub-reflector has an axially symmetric surface.

18. The inflatable antenna system of claim 17, wherein said sub-reflector is remotely modified or optimized.

19. The inflatable antenna system of claim 15 or 16, wherein said sub-reflector includes an array of RF reflective elements.

20. The inflatable antenna system of claim 19, wherein said array of RF reflective elements is remotely modified or optimized.

* * * * *